US006003663A

United States Patent [19]

Newcomer

[11] Patent Number: 6,003,663

[45] Date of Patent: Dec. 21, 1999

[54] EYEGLASS CASE

[75] Inventor: Charles H. Newcomer, Wilderville, Oreg.

[73] Assignee: Tec Vision, Inc., Murray, Utah

[21] Appl. No.: 08/977,431

[22] Filed: Nov. 24, 1997

[51] Int. Cl.[6] ..... A45C 11/04

[52] U.S. Cl. ..... 206/5; 206/315.1

[58] Field of Search ..... 206/765, 5, 6, 206/216, 315.1, 362

[56] References Cited

U.S. PATENT DOCUMENTS

| | | | |
|---|---|---|---|
| 51,957 | 1/1866 | Minor . | |
| D. 148,815 | 2/1948 | Olevin . | |
| D. 175,537 | 9/1955 | Combridge . | |
| D. 176,236 | 11/1955 | Stegeman . | |
| D. 179,462 | 12/1956 | Stegeman . | |
| 300,411 | 6/1884 | Borst . | |
| D. 351,945 | 11/1994 | Kopel . | |
| 410,798 | 9/1889 | Long . | |
| 1,004,474 | 9/1911 | Schnorr . | |
| 1,095,744 | 5/1914 | Smith . | |
| 1,277,210 | 8/1918 | Goelkel et al. . | |
| 1,427,947 | 9/1922 | Flitton . | |
| 1,469,524 | 10/1923 | McArthur . | |
| 1,486,119 | 3/1924 | Baker . | |
| 1,503,979 | 5/1924 | Callahan . | |
| 1,633,417 | 6/1927 | Perry . | |
| 1,649,255 | 11/1927 | Robinson . | |
| 1,995,664 | 3/1935 | Boyes . | |
| 1,999,328 | 4/1935 | Lessard . | |
| 2,187,176 | 1/1940 | Schutz . | |
| 2,187,178 | 1/1940 | Schutz . | |
| 2,233,859 | 3/1941 | Wick . | |
| 2,250,636 | 7/1941 | Jerry . | |
| 2,308,112 | 1/1943 | Schutz . | |
| 2,458,567 | 1/1949 | Cramer . | |
| 2,479,472 | 8/1949 | Coplon . | |
| 2,522,909 | 9/1950 | Wadanoli . | |
| 2,529,000 | 11/1950 | Cameron . | |
| 2,692,043 | 10/1954 | Davis . | |
| 2,710,685 | 6/1955 | Baratelli | 206/5 |
| 2,805,766 | 9/1957 | Nathan | 206/5 |
| 3,000,417 | 9/1961 | Goldstein . | |
| 3,050,181 | 8/1962 | Nathan | 206/5 |
| 3,070,141 | 12/1962 | Lowy . | |
| 3,144,127 | 8/1964 | Fogel . | |
| 3,232,638 | 2/1966 | Dishart . | |
| 3,785,480 | 1/1974 | Minasian . | |
| 4,865,186 | 9/1989 | Gates . | |
| 4,899,873 | 2/1990 | Bole et al. . | |
| 4,951,811 | 8/1990 | Lines . | |
| 4,960,208 | 10/1990 | Tempke . | |
| 4,984,682 | 1/1991 | Cummins | 206/5 |
| 5,014,846 | 5/1991 | Walker et al. . | |
| 5,016,749 | 5/1991 | Kaye et al. . | |
| 5,085,317 | 2/1992 | Jensen et al. | 206/362 |
| 5,249,675 | 10/1993 | Strauss et al. . | |
| 5,333,732 | 8/1994 | Budny et al. | 206/5 |
| 5,344,002 | 9/1994 | Baczkowski . | |
| 5,513,744 | 5/1996 | Yabarra | 206/5 |
| 5,590,760 | 1/1997 | Astarb | 206/5 |
| 5,706,935 | 1/1998 | Lorton . | |

*Primary Examiner*—Jacob K. Ackun

[57] ABSTRACT

An eyeglass case includes a substantially rigid internal shell member surrounded by a flexible covering material provided with a closure flap selectively securable in a closed position for retaining eyeglasses in protective storage within the inner shell member. The shell member includes an inverted V-shaped support member extending upwardly from a floor of the shell member which engages a nose recess of a pair of eyeglasses stored within the case. The shell member includes one or more internal receptacles for storage of miscellaneous accessory items such as nose pads, spare screws, a small screwdriver, lens cleaning solution, a lens wiping cloth, contact lenses, contact lens solutions, medications, etc.

12 Claims, 4 Drawing Sheets

EYEGLASS CASE

CROSS-REFERENCE TO RELATED APPLICATIONS

This application is generally related to U.S. patent application Ser. No. 08/833,319 for "Eyeglass Case With Hinged Cover," filed Apr. 4, 1997; U.S. patent application Ser. No. 08/834,319 for "Eyeglass Case With Closure Flap," filed Apr. 4, 1997; U.S. Design patent application Ser. No. 29/041,179 for "Eyeglass Container," filed Jul. 7, 1995; and U.S. Design patent application Ser. No. 29/069,097 for "Eyeglass Container," filed Apr. 10, 1997. The entire disclosures of each of the aforementioned patent applications are incorporated by this reference herein. Applicant has on even date herewith filed three generally related U.S. Design Patent Applications, each entitled "Eyeglass Case", which have been assigned Ser. Nos. 29/079,856, 29/079,883, and 29/079,988.

BACKGROUND OF THE INVENTION

The present invention relates to eyeglass cases and more particularly pertains to an eyeglass case having internal compartments for storing accessory items.

SUMMARY OF THE INVENTION

The present invention discloses an eyeglass case generally comprising a substantially rigid internal shell member surrounded by a flexible covering material provided with a closure flap selectively securable in a closed position for retaining eyeglasses in protective storage within the inner shell member. The shell member includes an inverted V-shaped support member extending upwardly from a floor of the shell member which engages a nose recess of a pair of eyeglasses stored within the case. In accordance with embodiments of the invention, the shell member includes one or more internal receptacles for storage of miscellaneous accessory items such as nose pads, spare screws, a small screwdriver, lens cleaning solution, a lens wiping cloth, etc.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
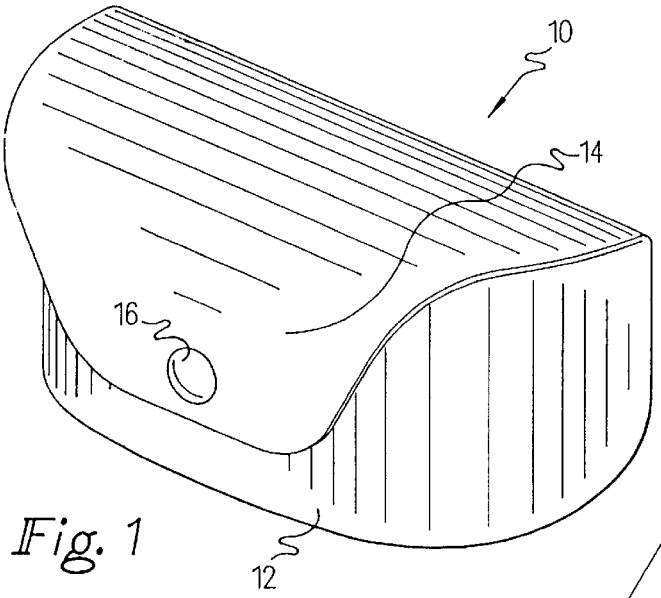
FIG. 1 is a perspective view illustrating an eyeglass case according to a first embodiment of the present invention, with the cover flap disposed in a closed position.
Figure 2:
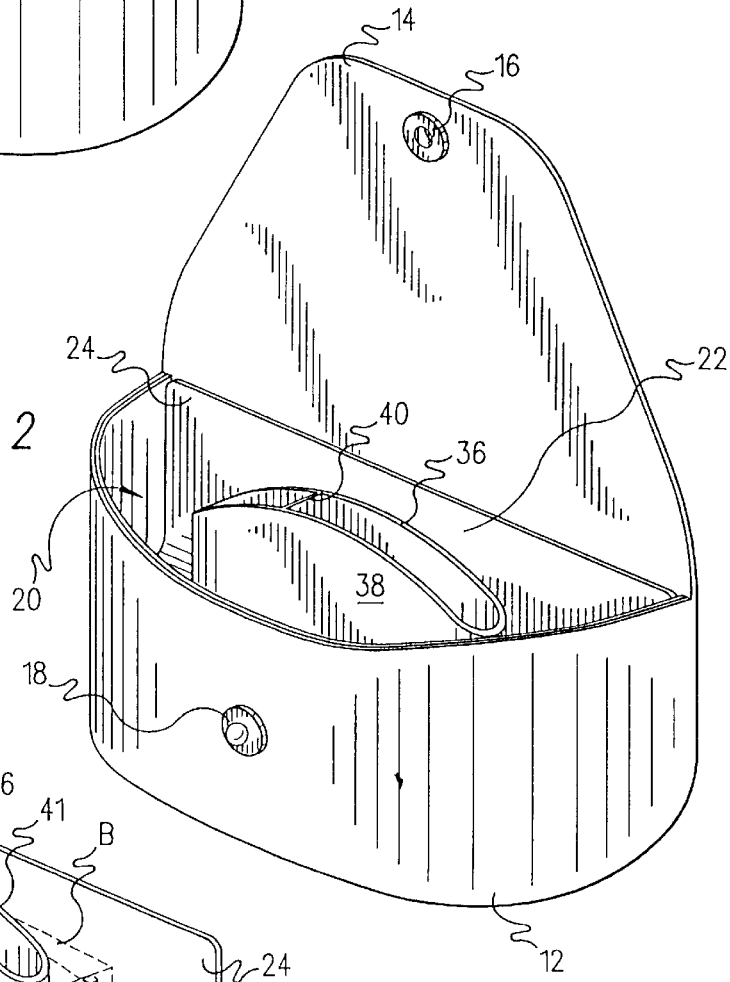
FIG. 2 is a perspective view of the eyeglass case of FIG. 1, with the cover disposed in an open position.
Figure 3:
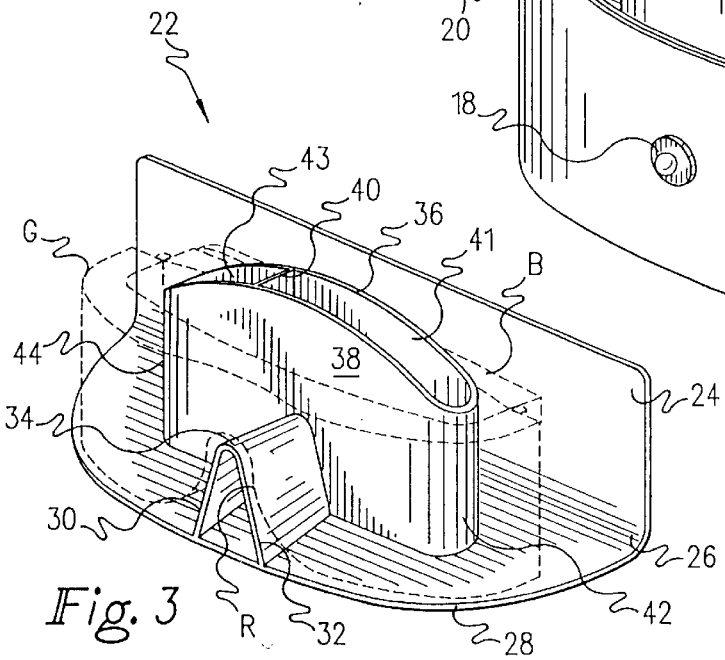
FIG. 3 is a perspective view illustrating an internal shell portion of the eyeglass case of FIGS. 1 and 2.

Referring now to the drawings, wherein like reference numerals designate corresponding structure throughout the views, and referring in particular to FIGS. 1 through 3, an eyeglass case 10 according to the present invention includes a substantially rigid inner shell member 22, preferably integrally molded from a plastic material. A cover 12, preferably formed from a flexible material such as fabric, leather, rubber, plastic, or the like, includes a closure flap 14 which may be selectively secured to a central front region of the cover 12 using a conventional fastener, such as cooperating hook and loop type fasteners (VELCRO®) or snap fasteners 16 and 18, to secure the case 10 in a closed configuration, defining an enclosed interior space 20 adapted for the protective storage of eyeglasses G. Selected portions of the cover 12 are preferably fastened to the shell 22 using conventional fastening techniques, such as adhesives.

The shell member 22 comprises a generally rectangular planar rear wall 24 obliquely connected to an arcuately curved planar floor 28 by a radiused bend 26. The shell member 22 also includes an inverted V-shaped support member formed by legs 30 and 32 which extend upwardly from a bottom region of the floor 28 and converge at an apex 24. The support member is adapted to at least partially support eyeglasses G thereon. In use, an individual folds the eyeglasses G and places them within the case 10, with the nose recess R of the eyeglasses G supported by the legs 30, 32 and the earbows B disposed in the space between walls 24 and 36, as shown in FIG. 3.

In accordance with an important aspect of the instant invention, a centrally disposed upstanding storage console includes a first partition wall 38 disposed in spaced, parallel relation with a second partition wall 36, such that the wall 36 defines a back face of the console. The walls 36 and 38, in conjunction with radiused opposite end walls 42 and 44, thus define at least one receptacle 41 adapted to receive and store miscellaneous accessory items. One or more dividers 40 may be disposed transversely between the walls 36 and 38 to form a plurality of separate storage receptacles, such as receptacles 41 and 43.

The floor panel 28 preferably extends between walls 36 and 38 to close the bottom of the receptacles 41 and 43. The closure flap 14 of the cover 12 covers the open upper end of the receptacles 41 and 43, when the flap 14 is disposed in the closed position shown in FIG. 1. To access the contents of the receptacles 41 and 43, a user unfastens and opens the flap 14. Optionally, an additional cover for the receptacles 41 and 43 may be employed.

Numerous different arrangements, sizes, configurations, dimensions, and accessory item storage arrangements are possible within the scope of the present invention by providing differently configured shells 22 and using the identical cover 12. As shown in FIG. 2, one or more transverse dividers 40 may be disposed between the walls 38 and 36 to form a plurality of storage receptacles.

Figure 4:
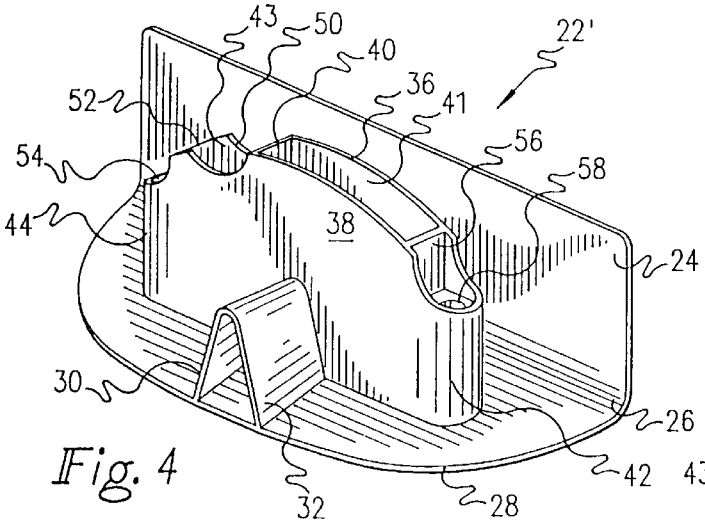
FIG. 4 is a perspective view illustrating a modified internal shell construction of an eyeglass case according to an alternative embodiment of the instant invention.
Figure 5:
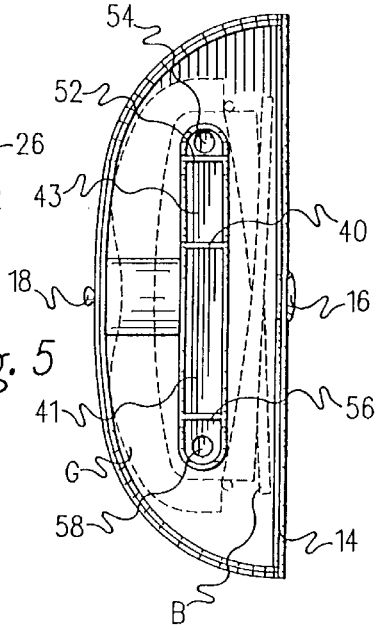
FIG. 5 is a top plan view illustrating an eyeglass case employing the shell illustrated in FIG. 4.
Figure 6:
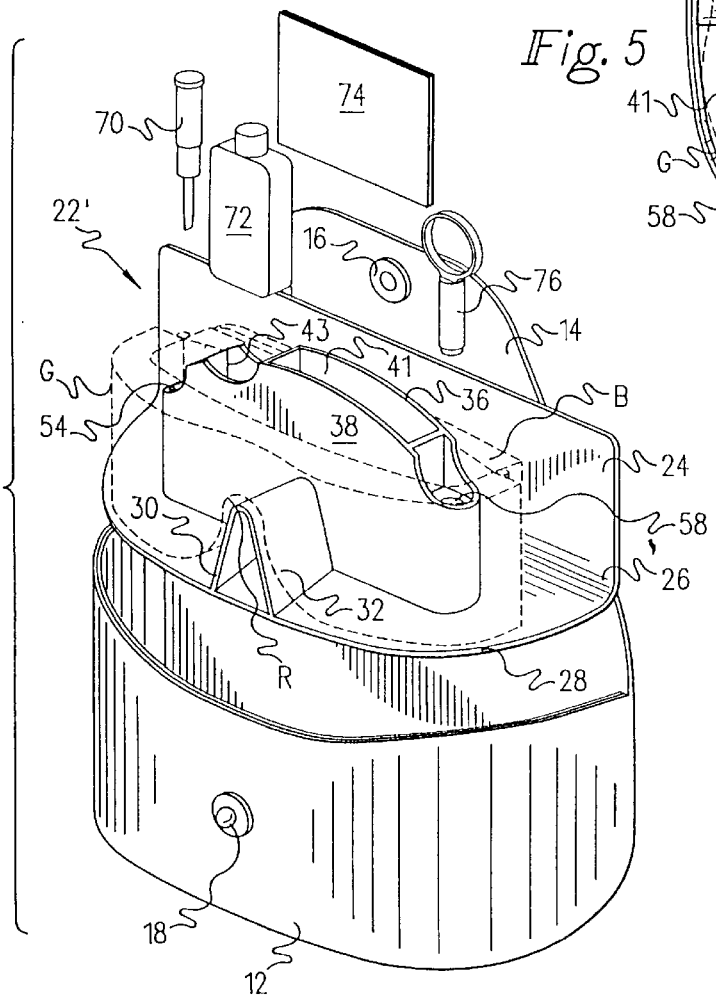
FIG. 6 is an exploded perspective view illustrating the eyeglass case of FIG. 5, and various accessory items optionally storable therein.

FIGS. 4 through 6 illustrate an alternative construction of the shell member 22' which includes transverse dividers 52, and 56 forming receptacles 54 and 58 disposed adjacent respective opposite end regions of the storage console. As shown in FIG. 4, cut-out regions 50 formed in one or both of walls 38 and 36 may be provided to facilitate removal of items from the receptacles. Example accessory items include a small screwdriver 70, a bottle of lens cleaning solution 72, a cleaning cloth 74, and a magnifying glass 76.

Figure 7:
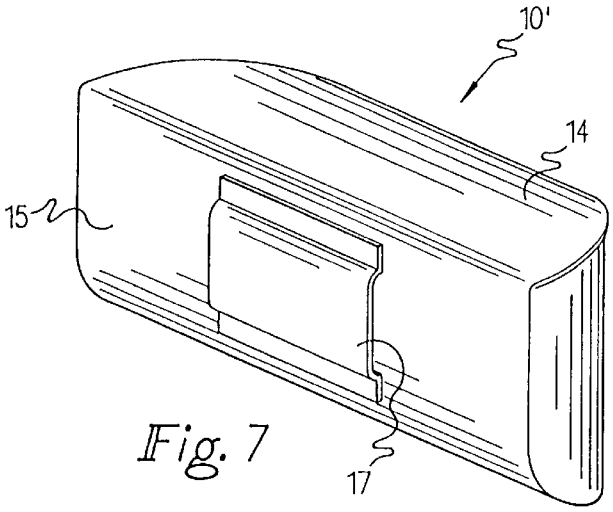
FIG. 7 is a rear perspective view of an eyeglass case according to the present invention having an optional belt loop.
Figure 8:
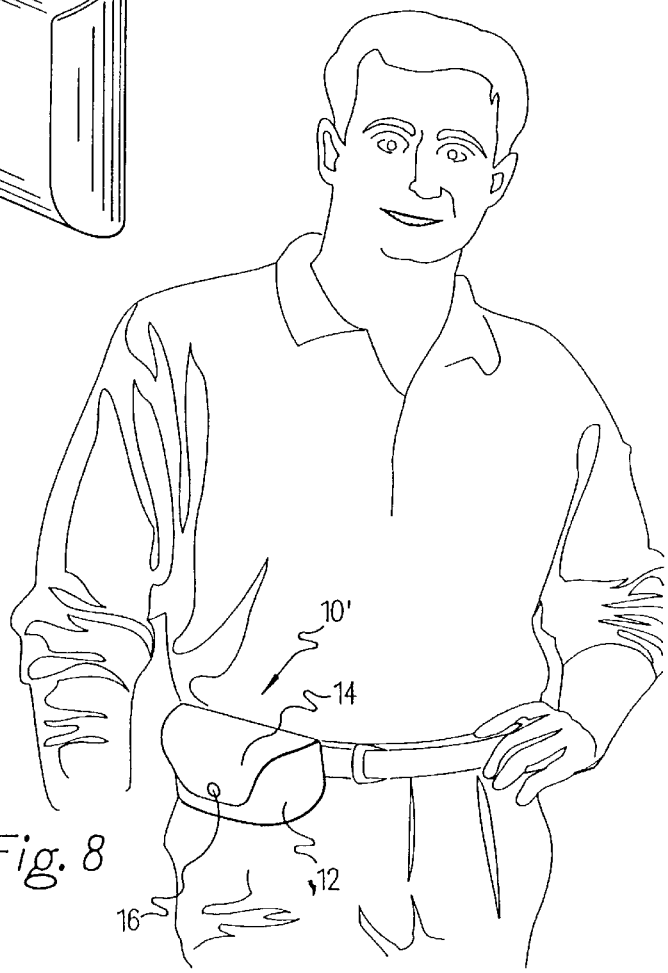
FIG. 8 is a perspective view illustrating an individual wearing the eyeglass case of FIG. 7 on his belt.

FIGS. 7 and 8 illustrate an alternative embodiment of an eyeglass case 10' provided on a back face 15 with a belt loop 17 to permit an individual to conveniently carry the case 10' on their belt.

Figure 9:
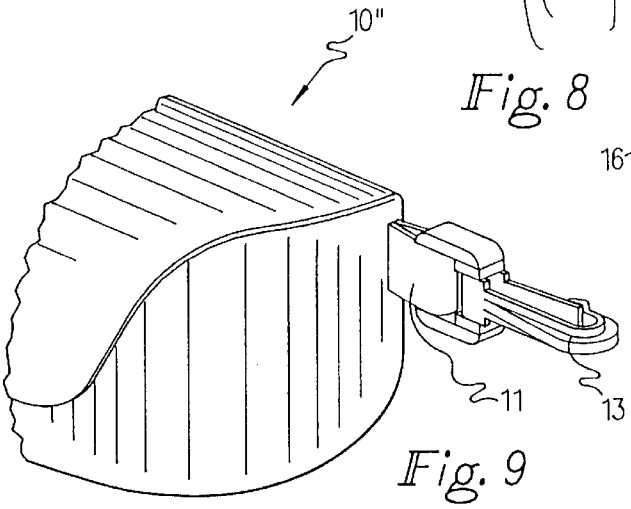
FIG. 9 is a partial perspective detail view of an eyeglass case according to the present invention having an optional attachment clip disposed on one end thereof.

FIG. 9 illustrates another alternative embodiment of an eyeglass case 10" provided with a spring clip 13 secured adjacent a corner of the case 10" by a loop strap 11 for the purpose of attaching the case 10" to various items such as a handbag strap, a golf bag, a belt, a backpack, etc.

Figure 10:
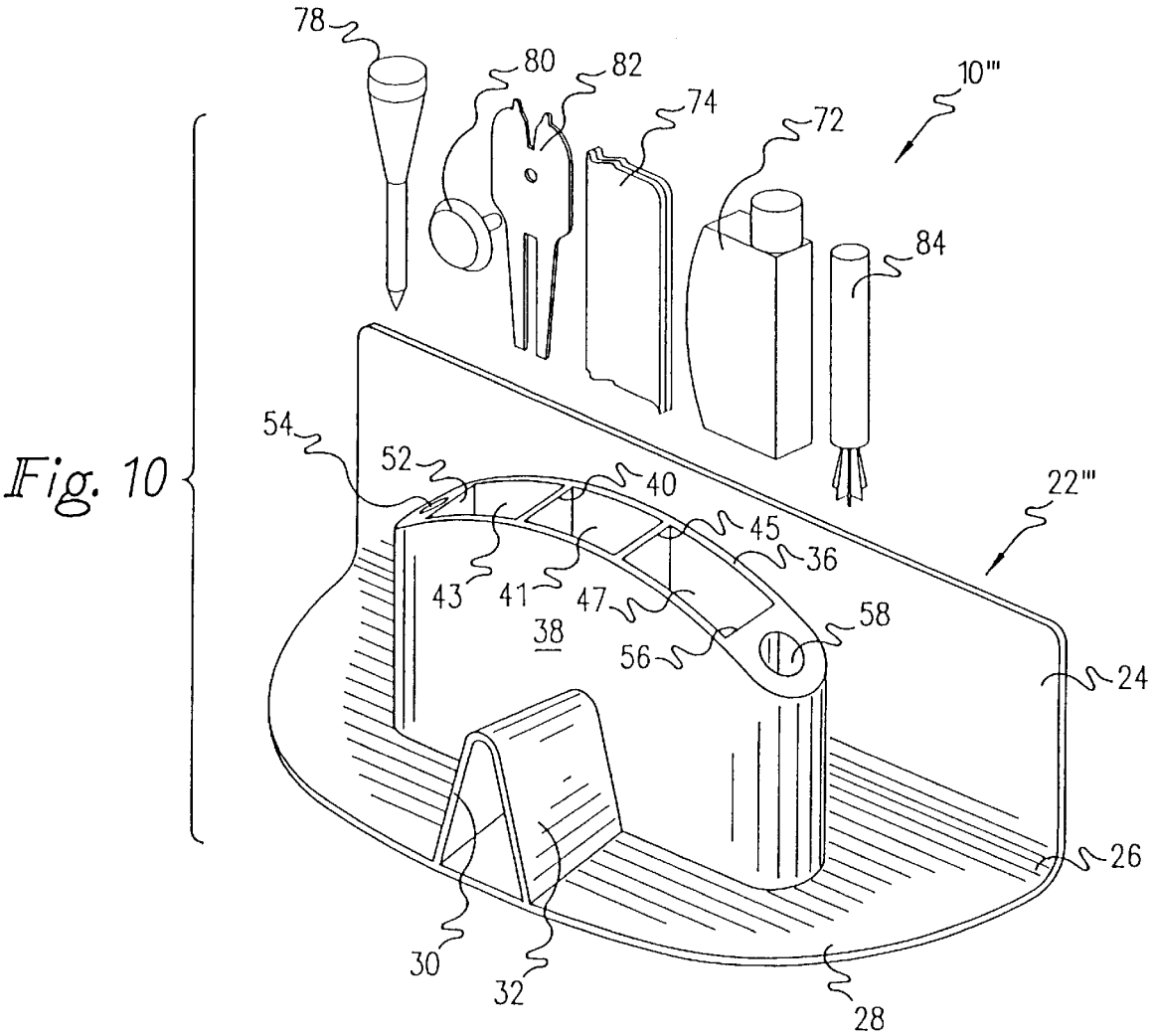
FIG. 10 is a perspective view illustrating a modified internal shell construction of an eyeglass case adapted for storage of golf accessory items according to a further alternative embodiment of the instant invention.

FIG. 10 illustrates a further alternative embodiment of a case 10'" including a modified shell member 22'" provided with receptacles 54, 43, 41, 47, and 58 for the storage of miscellaneous golf accessory items which may include: a tee 78, a ball marker 80, a divot and cleat tool 82, a cleaning cloth 74, a bottle of cleaning solution 72, and a brush 84.

The above illustrated and described alternative shell configurations are exemplary only, and numerous other shell configurations, dimensions, and associated accessory items may be provided without departing from the intended scope and content of the instant invention.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed, and reasonable equivalents thereof.

What is claimed is:

1. An eyeglass case, comprising:

an inner shell member including a substantially planar rear wall obliquely connected to a floor;

an inverted V-shaped support upstanding from said floor, said support dimensioned and disposed to engage a nose recess of a pair of eyeglasses stored within said case;

a cover substantially surrounding said inner shell member and provided with a closure flap for selectively securing eyeglasses within said inner shell member; and said shell member including a pair of spaced partition walls forming at least one internal receptacle for storage of accessory items.

2. The eyeglass case of claim 1, wherein said shell member comprises a substantially rigid member.

3. The eyeglass case of claim 1, wherein said cover comprises a substantially flexible material.

4. The eyeglass case of claim 1, wherein said partition walls are substantially planar and are substantially disposed in parallel spaced relation.

5. The eyeglass case of claim 4, further comprising at least one divider extending between said partition walls, said divider forming a plurality of internal receptacles.

6. The eyeglass case of claim 1, wherein said at least one receptacle comprises a plurality of receptacles.

7. The eyeglass case of claim 1, wherein said closure flap substantially overlies and closes an open upper end of said internal receptacle in a closed position of said flap.

8. An eyeglass case, comprising:

an inner shell member comprising a substantially rigid material, said inner shell member including a substantially planar rear wall obliquely connected to a floor;

an inverted V-shaped support upstanding from said floor, said support dimensioned and disposed to engage a nose recess of a pair of eyeglasses stored within said case;

a cover comprising a substantially flexible material, said cover substantially surrounding said inner shell member and provided with a closure flap for selectively securing eyeglasses within said inner shell member; and said shell member including a pair of spaced substantially parallel partition walls forming at least one internal receptacle for storage of accessory items, one of said partition walls disposed in spaced substantially parallel relation with a back wall of said shell to form a space dimensioned and disposed to receive earbow portions of a pair of eyeglasses stored within said case.

9. The eyeglass case of claim 8, further comprising at least one divider extending between said partition walls, said divider forming a plurality of internal receptacles.

10. The eyeglass case of claim 8, wherein said closure flap substantially overlies and closes an open upper end of said internal receptacle in a closed position of said flap.

11. The eyeglass case of claim 8, wherein at least one of said partition walls includes a cut out portion to facilitate removal of an accessory item from said receptacle.

12. The eyeglass case of claim 8, further wherein said at least one receptacle comprises a plurality of receptacles.

* * * * *